US005730636A

United States Patent [19]

Stansbury

[11] Patent Number: 5,730,636

[45] Date of Patent: Mar. 24, 1998

[54] SELF-DIMENSIONING SUPPORT MEMBER FOR USE IN A FIELD EMISSION DISPLAY

[75] Inventor: Darryl M. Stansbury, Boise, Id.

[73] Assignee: Micron Display Technology, Inc., Boise, Id.

[21] Appl. No.: 536,710

[22] Filed: Sep. 29, 1995

[51] Int. Cl.[6] ..... H01J 9/24

[52] U.S. Cl. ..... 445/25

[58] Field of Search ..... 445/24, 25; 257/717, 257/687, 688, 729

[56] References Cited

U.S. PATENT DOCUMENTS 3,424,909 1/1969 Rougeot .
3,979,621 9/1976 Yates .
3,990,874 11/1976 Schulman .
4,081,825 3/1978 Koopman et al. ..... 257/717 X

FOREIGN PATENT DOCUMENTS 2-165540 6/1990 Japan .
3-179630 8/1991 Japan .

*Primary Examiner*—Kenneth J. Ramsey
*Attorney, Agent, or Firm*—Hale and Dorr LLP

[57] ABSTRACT

According to an aspect of the present invention, a process is provided for manufacturing a field emission display. In one embodiment, the process comprises disposing a self-dimensioning support member between a backplate assembly and a die assembly, and positioning the die assembly and the backplate assembly relative to each other such that the self-dimensioning support member is dimensioned relative to the distance between the assemblies.

18 Claims, 4 Drawing Sheets

SELF-DIMENSIONING SUPPORT MEMBER FOR USE IN A FIELD EMISSION DISPLAY

BACKGROUND OF THE INVENTION

This invention relates to the field of electronic displays, and, more particularly, field emission display ("FED") devices.

As technology for producing small, portable electronic devices progresses, so does the need for electronic displays which are small, provide good resolution, and consume small amounts of power in order to provide extended battery operation. Past displays have been constructed based upon cathode ray tube ("CRT") or liquid crystal display ("LCD") technology. However, neither of these technologies is perfectly suited to the demands of current electronic devices.

CRT's have excellent display characteristics, such as, color, brightness, contrast and resolution. However, they are also large, bulky and consume power at rates which are incompatible with extended battery operation of current portable computers.

LCD displays consume relatively little power and are small in size. However, by comparison with CRT technology, they provide poor contrast, and only limited ranges of viewing angles are possible. Further, color versions of LCDs also tend to consume power at a rate which is incompatible with extended battery operation.

As a result of the above described deficiencies of CRT and LCD technology, efforts are underway to develop new types of electronic displays for the latest electronic devices. One technology currently being developed is known as "field emission display technology." The basic construction of a field emission display, or ("FED") is shown in FIG. 1. As seen in the figure, a field emission display comprises a face plate 100 with a transparent conductor 102 formed thereon. Phosphor dots 112 are then formed on the transparent conductor 102. The face plate 100 of the FED is separated from a baseplate 114 by a spacer 104. The spacers serve to prevent the baseplate from being pushed into contact with the faceplate by atmospheric pressure when the space between the baseplate and the faceplate is evacuated. A plurality of emitters 106 are formed on the baseplate. The emitters 106 are constructed by thin film processes common to the semi-conductor industry. Millions of emitters 106 are formed on the baseplate 114 to provide a spatially uniform source of electrons.

However, it has been difficult in the past to make a field emission display with the required mechanical strength for a suitable commercial device. Some of the problems that have been encountered are described with respect to FIG. 2. As shown, the field emission display comprises a glass substrate 200 having a rail, or spacer, 204 provided with conductors 208 for connecting a die, or cathode 202 to a bonding wire 210 which in turn is connected to conductor 212 located on the glass substrate 200. Collectively, these parts are referred to as the "die assembly." The die assembly is then connected to the backplate assembly, comprising the backplate 200 bonded to a seal ring 216 by frit material 218. The die assembly is joined to the backplate assembly by frit material 214 and then the space between the die assembly and the backplate assembly is evacuated. However, as seen in the figure, die 202 is attached to the rail 204 only by its electrical connection with rail conductors 208. This connection typically employs flip chip bonding. The bond between die 202 and rail 204 is fragile and is subject to separation when the space between the die assembly and the backplate assembly is evacuated or when the device is subject to a mechanical impact, for example being dropped. Clearly, when the die 202 is separated from the rail 204, the device it is completely destroyed.

It has been reported that the above-mentioned problem could be addressed by placing the backplate 220 in contact with the die 202 or another member of the die assembly, such as getter 206, which is connected to the die 202. However, such a device is difficult to manufacture and would have the effect of placing two relatively flat substrates in contact with each other, raising the possibility that pockets of contaminants would be created when the space between the die assembly and the backplate assembly is evacuated.

It has also been reported that, in another attempt to solve the above-mentioned problem, a support member, or standoff (not shown) is placed between the backplate 220 and the die 202, or getter 206. However, such a device is difficult to manufacture. For example, frit layer 214 is used to join the die assembly to the backplate assembly. When the assemblies are joined, the frit layer 214 is heated and the assemblies are pressed against each other, thus compressing frit layer 214. Therefore, it is important that the support member be precisely machined to fit the space between the die assembly and the backplate assembly, taking into account the compression of frit layer 214. If the support member (not shown) is improperly machined, it will either prevent the die assembly from sufficiently compressing frit layer 214, or it will leave a gap between the die assembly and the backplate assembly and, thus, fail to provide the proper support. Moreover, the support also prevents deflection of glass due to vacuum when sealed.

Accordingly, there is a need in the art for a field emission display having a support member which will overcome the above-mentioned problems.

SUMMARY OF THE INVENTION

According to an aspect of the present invention, a process is provided for manufacturing a field emission display. In one embodiment, the process comprises disposing a self-dimensioning support member between a backplate assembly and a die assembly, and positioning the die assembly and the backplate assembly relative to each other such that the self-dimensioning support member is dimensioned relative to the distance between the assemblies.

According to another embodiment of the invention, a field emission display is provided comprising a die assembly having a cathode in electrical connection with a rail conductor, a backplate assembly having a backplate joined with a seal ring, wherein the die assembly is sealed together with the backplate assembly, a sealing member disposed between the backplate assembly and the die assembly, and a support member compressed between the backplate assembly and the die assembly.

BRIEF DESCRIPTION OF THE DRAWINGS

For a more complete understanding of the invention and for further advantages thereof, reference is made to the following Detailed Description taken in conjunction with the accompanying drawings, in which.

It is to be noted, however, that the appended drawings illustrate only typical embodiments of this invention and are therefore not to be considered limiting of its scope, for the invention may admit to other equally effective embodiments.

DETAILED DESCRIPTION OF EMBODIMENTS OF THE INVENTION

Figure 3:
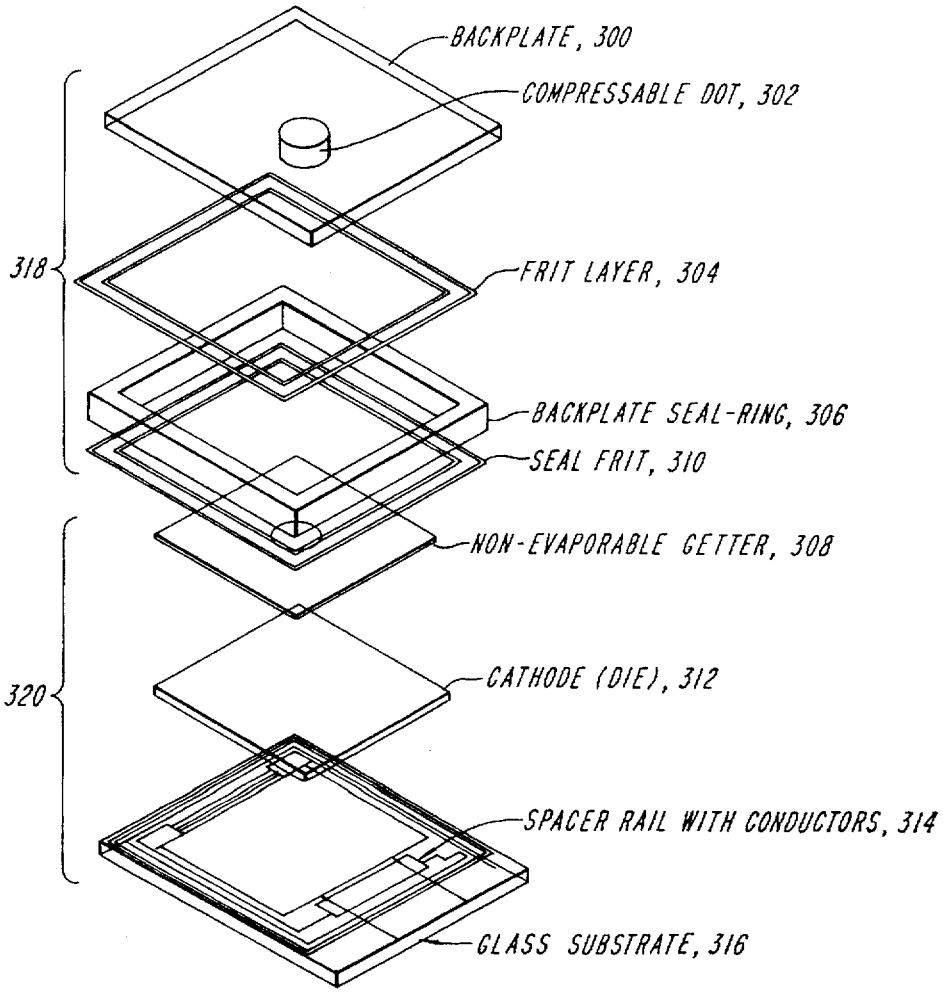
FIG. 3 is an exploded diagram showing a field emission display according to an embodiment of the invention.

Referring now to FIG. 3, a process is provided for manufacturing a field emission display. In one embodiment, the process comprises disposing a self-dimensioning support member 302 between a backplate assembly 318 and a die assembly 320, and positioning the die assembly 320 and the backplate assembly 318 relative to each other such that the self-dimensioning support member 302 is dimensioned relative to the distance between the assemblies 318, 320. In the FIG. 3 embodiment, the backplate assembly 318 comprises a backplate 300, a backplate sealring 306, and a frit layer 304 used to seal the backplate 300 to the backplate sealring 306. The die assembly 320 comprises a glass substrate 316 provided with a rail 314 having electrical conductors to connect to the die 312. On one side of the die 312 there is provided a non-evaporatable getter 308. The die assembly 320 is bonded to the backplate assembly 318 at the backplate seal ring 306 by seal frit 310. Those of skill in the art will recognize that this embodiment represents only one way the backplate assembly 318 and die assembly 320 could be formed. Other arrangements, and other components are possible. For example, the non-evaporatable getter 308 does not necessarily have to be placed on the backplate side of the die 312, but could be arranged in other locations within the display. As shown in the figure, there is a self-dimenisioning support member 302 provided between the backplate assembly 318 and the die assembly 320.

Figure 1:
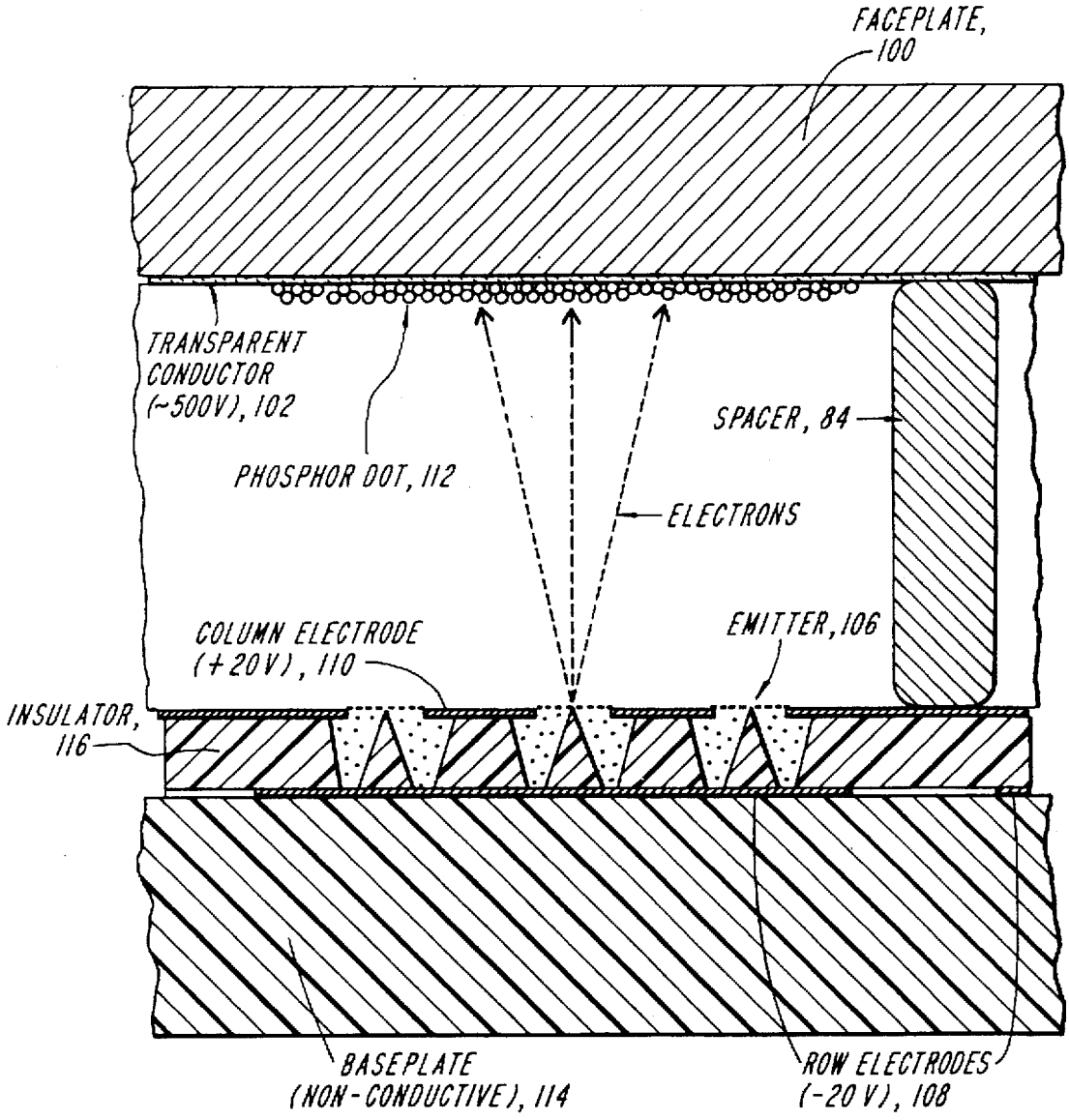
FIG. 1 (PRIOR ART)
FIG. 1 is a plan view of a typical field emission display showing its basic operation.
Figure 2:
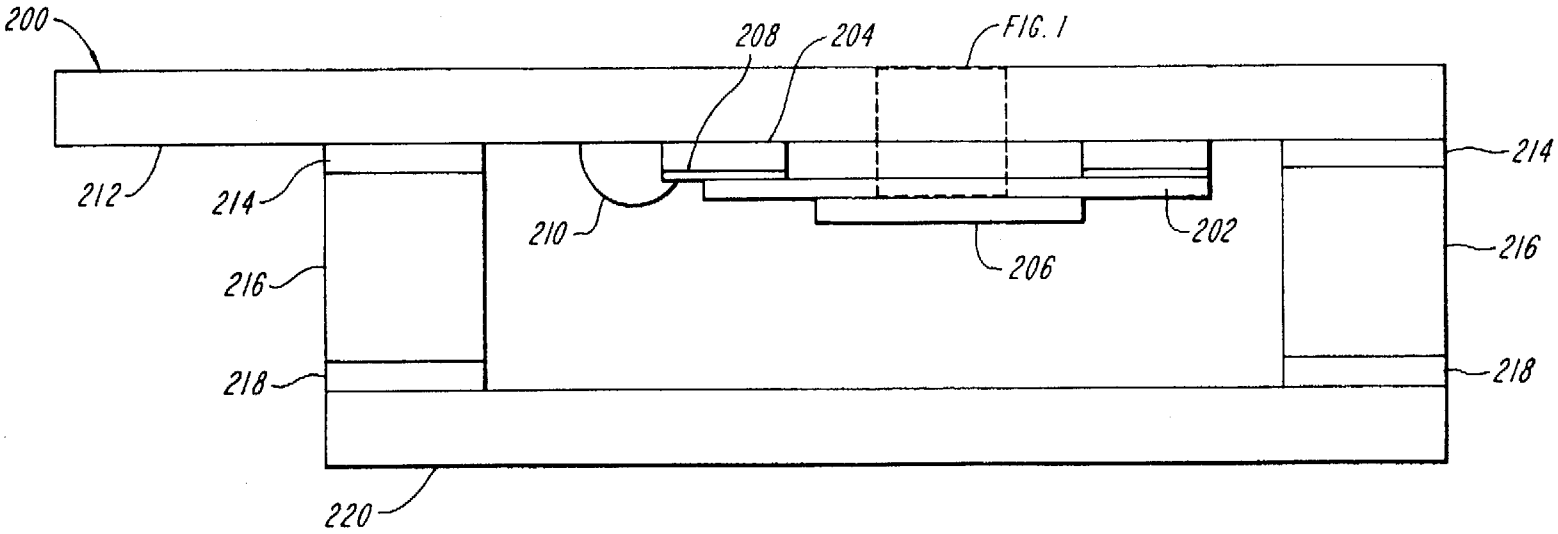
FIG. 2 (PRIOR ART)
FIG. 2 is a plan view of a field emission display.
Figure 4:
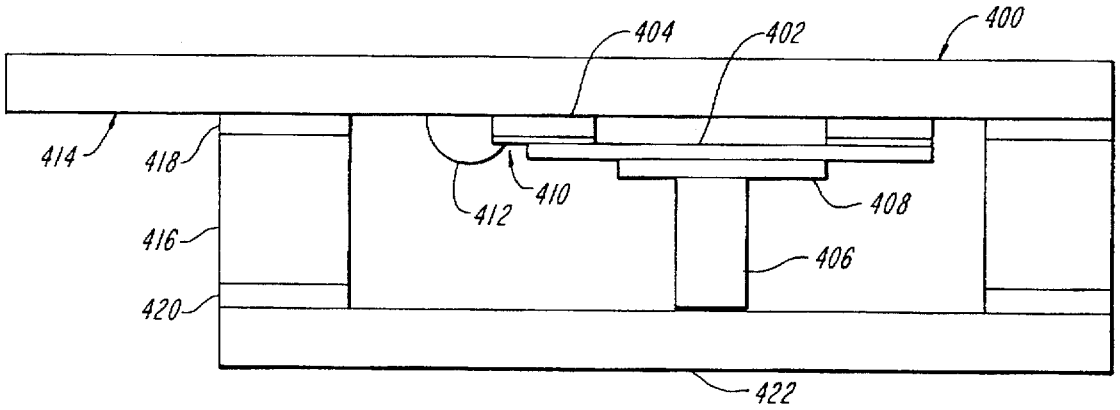
FIG. 4 is a plan view of a field emission display according to an embodiment of the invention.

FIG. 4 is a plan view of a field emission display according to an embodiment of the invention. In this embodiment, the die assembly comprises glass substrate 400, rail 404 having conductors 410, which are bonded by bond wire 412 to substrate conductor 414, die 402 and getter 408. The backplate assembly comprises backplate 422 which is joined to backplate seal ring 416 by frit layer 420. Of course, as stated previously, those of skill in the art will recognize that other arrangements are possible. For example, getter 408 could be constructed as part of the backplate assembly by attaching it to backplate 422 and disposing the self-dimensioning support member 406 between die 402 and getter 408.

With the self-dimensioning support member 406 placed as shown, it is seen that support is provided for die 402. This support prevents die 402 from separating from rail 404 when the device is evacuated or subjected to a mechanical impact.

Figure 5:
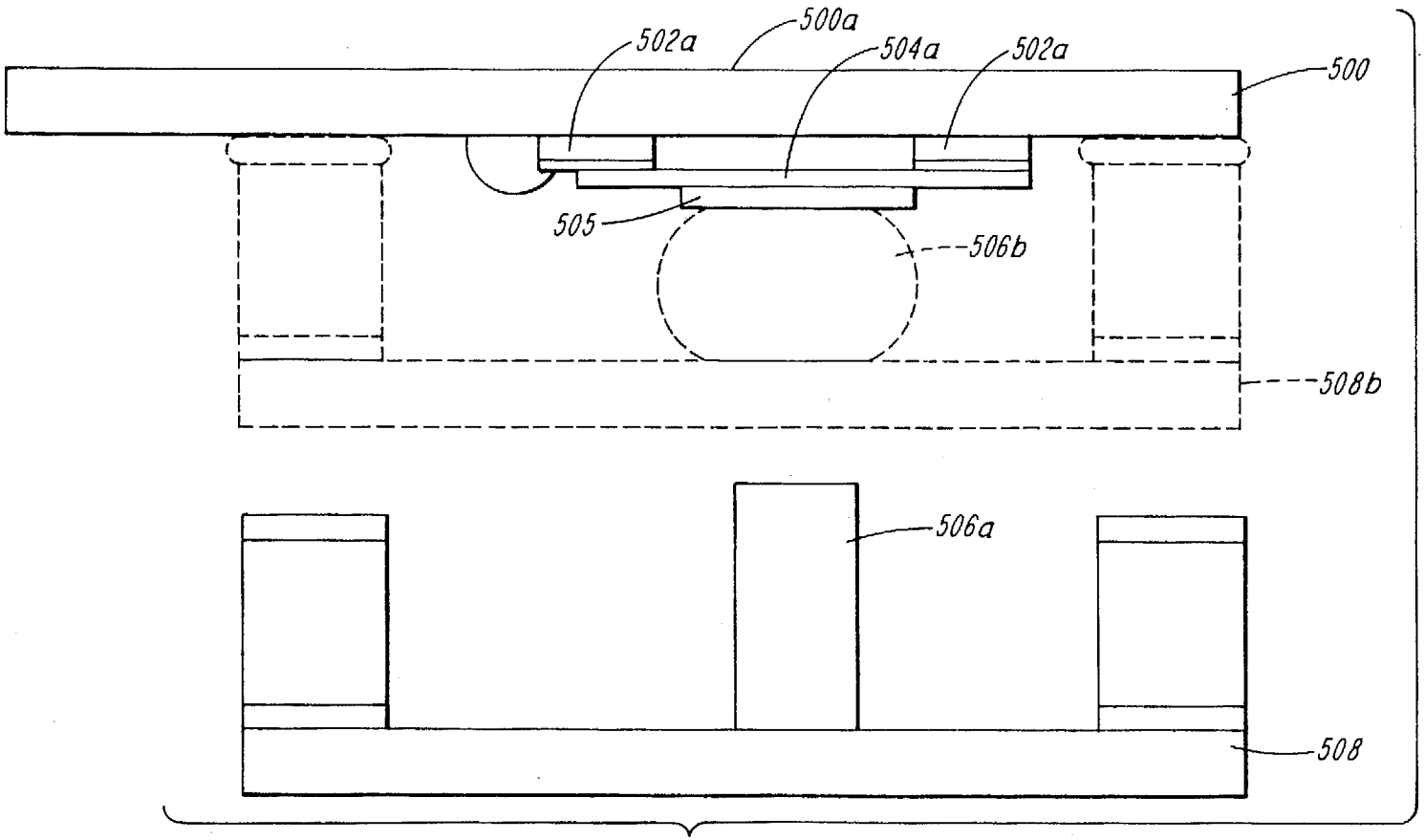
FIG. 5 is a plan view of a field emission display showing the operation of the self-dimensioning member.

FIG. 5 is a plan view of an embodiment of the invention showing the operation of the self-dimensioning support member 506*a*. In this embodiment, the die assembly comprises the glass substrate 500*a*, rail 502*a* getter 505, and die 504*a*. The backplate assembly comprises a substrate 508. Self-dimensioning support member 506*a* is placed between the die assembly and the backplate assembly as shown. When the assemblies are sealed together, the die assembly is positioned towards substrate 508 until it reaches the position shown by the dotted lines. As shown, when the device is assembled, substrate 508 will be at the position of the dotted lines 508*b*. Self-dimensioning member 506*a* will expand outwardly as it is compressed and will be dimensioned as shown by dotted lines 506*b*. The height of the member 506*b* will conform to the distance between the die assembly and the backplate assembly as shown.

Referring again to FIG. 4, an embodiment of the invention, is provided in which the step of disposing a self-dimensioning support member 406 comprises disposing the support member 406 on the backplate 422. Alternatively, the step of disposing a self-dimensioning support member 406 comprises disposing the support member 406 on the die assembly, for example on getter 408.

According to another embodiment of the invention, the step of disposing a self-dimensioning support member 406 comprises disposing a frit material between the backplate assembly and the die assembly. An example of a frit known to be useful with the present invention is LS-1301 manufactured by Nippon electric Glass Co. However, the frit is not critical as long as the coefficient of thermal expansion ("CTE") of the frit matches that of the glass used in the backplate assembly. Other examples of frits known to be useful with the present invention will occur to those of skill in the art. Of course, in according to other aspects of the invention, other materials are used to seal the backplate assembly rather than a frit.

In another aspect, the self-dimensioning support member 406 comprises a frit material which has a lower melting point, or flowing point, than the frit material 420 used to connect the sealring 416 to the backplate 422. In this way, it is possible to heat the FED to the point where the frit forming the self-dimensioning support member 406 softens so that it will compress when the die assembly is positioned with respect to the backplate assembly without softening the frit material 420 used to connect the backplate 422 to the sealring 416.

It is desirable to select a frit material for the self-dimensioning support member 406 which has a thermal coefficient of expansion similar to that of the backplate 422. This results in a device in which the self-dimensioning support member 406 will expand and contract proportionally to the backplate 422 as the device is heated and cooled. Therefore, damage to the die is prevented.

Several methods are available for disposing the frit material on the backplate or die assembly. For example, in one version of the invention, the frit material is disposed from a syringe or screen printing onto the backplate 422.

In still a further embodiment of the invention, it is useful to "pre-glaze" the frit before the die assembly and the backplate assembly are positioned together. In one embodiment, the frit is pre-glazed by heating it to some level below its flow point to make it sticky so that it adheres to the backplate 422. For example, in one version of the invention, the frit is heated to between about 355° to about 365° C. After the frit has been pre-glazed, the die assembly and the backplate assembly are assembled together with tension rings, or some other suitable device to hold them in a desired spatial relationship. They are then heated in a vacuum chamber at a temperature sufficient to cause a permanent bonding between the die assembly and the backplate assembly at the seal ring 416 by seal frit 418.

Of course, the vacuum pressure in the vacuum chamber is controlled during assembly of the device to be as low as possible. In one embodiment, an acceptable vacuum pressure is about $10^{-5}$ torr.

According to still a further embodiment of the invention, there is provided a field emission display comprising a die assembly having a glass substrate 400, the rail being a rail 404 provided with conductors 410 attached to substrate conductors 414 by bond wire 412, and a die 402, the die assembly being sealed by a frit layer 418 to a backplate assembly, the backplate assembly having a seal ring 416 connected to a backplate 422 by frit layer 420, and a self-dimensioning support member 406 comprising a frit having a lower melting point than frit layer 420, disposed between the backplate assembly and the die assembly.

What is claimed is:

1. A process for manufacturing a field emission display, the process comprising the steps of:

disposing a self-dimensioning support member between a backplate assembly and a die assembly, the die assembly including a display screen and an electron emitting cathode for emitting electrons to the display screen; and positioning the die assembly and the backplate assembly relative to each other such that the self-dimensioning support member is dimensioned relative to the distance between the assemblies.

2. A process as in claim 1, wherein the step of disposing a self-dimensioning support member comprises disposing the support member on the backplate before the positioning step.

3. A process as in claim 1, wherein the step of disposing a self-dimensioning support number comprises disposing the support member on a side of the electron emitting cathode before the positioning step.

4. A process for manufacturing a field emission display, the process comprising the steps of:

disposing a self-dimensioning support member between a backplate and a die assembly, wherein the disposing step includes disposing a first material between the backplate assembly and the die assembly; and positioning the die assembly and the backplate relative to each other such that the self-dimensioning support member is dimensioned relative to the distance between the die assembly and the backplate.

5. A process as in claim 4, wherein the step of positioning includes bonding the backplate assembly to a seal ring with a second frit material, and the step of disposing a first frit material comprises disposing a frit material having a lower melting point than the melting point of the second frit material.

6. A process as in claim 4, wherein the step of disposing a first frit material comprises disposing a frit material having a thermal coefficient of expansion similar to that of the backplate.

7. A process as in claim 4, wherein the step of disposing a first frit material comprises disposing, through a syringe, a frit material comprising a solvent.

8. A process as in claim 4, further comprising a step of preglazing the first frit material before the positioning step

9. A process as in claim 4, wherein the step of positioning includes bonding the backplate assembly to a seal ring with a second frit material, and the step of disposing a first frit material comprises disposing a frit material having a slightly higher melting point than the melting point of the second frit material.

10. A display device comprising:

a backplate assembly;

a die assembly sealed to the backplate assembly, the die assembly including a display screen and an electron emitting cathode for emitting electrons to the display screen;

a self-dimensioning, compressable, and deformable support member disposed between the backplate assembly and the cathode of the die assembly.

11. A process for manufacturing a display device, the process comprising the steps of:

disposing a compressible and deformable support member between a backplate and a first side of a cathode, the cathode having a second side that faces a display screen and away from the backplate; and assembling the cathode and backplate together to compress and deform the support member is so that it is dimensioned relative to the distance between the cathode and the backplate.

12. The process of claim 11, wherein the display is a field emission display, the cathode having a number of electron emitters on the second side for emitting electrons to the display screen, the disposing step including disposing the support member between the first side of the cathode and a baseplate.

13. The display device of claim 10, wherein the display is a field emission display, the cathode having a number of emitters for emitting electrons to the display screen.

14. The display device of claim 10, wherein the support member is made of a first frit material.

15. The display device of claim 10, wherein the die assembly is sealed to the backplate assembly with a seal ring and a second frit material.

16. The display device of claim 10, wherein the second frit material has a higher melting point than the melting point of the first frit material.

17. The display device of claim 10, wherein a getter material is provided on the cathode.

18. The display device of claim 10, wherein the support member has a coefficient of thermal expansion similar to that of the backplate.

* * * * *